US008776691B2

(12) United States Patent
Kravel

(10) Patent No.: US 8,776,691 B2
(45) Date of Patent: Jul. 15, 2014

(54) LAUNCHED SMOKE GRENADE

(75) Inventor: Jacob Kravel, Great Neck, NY (US)

(73) Assignee: CSI-Penn Arms, LLC, Jamestown, PA (US)

( * ) Notice: Subject to any disclaimer, the term of this patent is extended or adjusted under 35 U.S.C. 154(b) by 17 days.

(21) Appl. No.: 13/488,365

(22) Filed: Jun. 4, 2012

(65) Prior Publication Data

US 2013/0319278 A1 Dec. 5, 2013

(51) Int. Cl.
*F42B 12/48* (2006.01)

(52) U.S. Cl.
USPC ..... 102/334

(58) Field of Classification Search
CPC ..... F42B 12/48
USPC ..... 102/334, 364, 367, 368, 370, 502, 482, 102/487
See application file for complete search history.

(56) References Cited

U.S. PATENT DOCUMENTS 3,601,053 A * 8/1971 Grall et al. ..... 102/334
3,713,394 A * 1/1973 Dare et al. ..... 102/334
4,186,664 A * 2/1980 Huber et al. ..... 102/334
4,324,183 A * 4/1982 Prahauser et al. ..... 102/334
4,435,233 A * 3/1984 Rayer et al. ..... 149/44
4,454,816 A * 6/1984 Billard et al. ..... 102/430
4,505,202 A * 3/1985 Fidler et al. ..... 102/357
4,622,899 A * 11/1986 Weber ..... 102/334
4,697,521 A * 10/1987 Espagnacq et al. ..... 102/334
4,860,657 A * 8/1989 Steinicke et al. ..... 102/334
5,783,768 A * 7/1998 Jacobson ..... 102/334
5,872,325 A * 2/1999 Feldmeier et al. ..... 102/334
5,997,667 A * 12/1999 Jacobson ..... 149/37
6,283,032 B1 * 9/2001 Wardecki ..... 102/334
6,612,242 B2 * 9/2003 Raupp et al. ..... 102/334
8,220,392 B1 * 7/2012 Maldonado et al. ..... 102/368
8,464,641 B2 * 6/2013 O ..... 102/334

* cited by examiner

*Primary Examiner* — James Bergin
(74) *Attorney, Agent, or Firm* — Bennet K. Langlotz; Langlotz Patent & Trademark Works, Inc.

(57) ABSTRACT

A launched smoke grenade has a cartridge case having a hollow interior that receives a primer and a propellant, a projectile received by the cartridge case, and the projectile including a smoke generation component and an ignition component. The smoke generation component and the ignition component may be separated by a barrier prior to admission of the ignition component. The ignition component may burn through the barrier to ignite the smoke generation component. The smoke generation component may include hexachloroethane. The propellant may be black powder or smokeless powder.

12 Claims, 4 Drawing Sheets

LAUNCHED SMOKE GRENADE

FIELD OF THE INVENTION

The present invention relates to smoke grenades, and more particularly to a smoke grenade that is propelled from a launcher.

BACKGROUND OF THE INVENTION

Smoke grenades are canister-type grenades used as ground-to-ground or ground-to-air signaling devices, target, or landing zone marking devices, or as screening devices for unit movements. Smoke grenades generally have a sheet steel cylinder with at least one emission hole to allow smoke release when the grenade is ignited. Smoke grenades can be either tossed by hand or launched from a firearm. The body of hand tossed smoke grenades is often filled with hexachloroethane, which makes thick heavy black smoke.

Conventional launched grenades have the benefit of traveling farther than hand tossed smoke grenades, providing significant accuracy and range advantages. However, the difficulty with using hexachloroethane in a launched smoke grenade is that hexachloroethane must be kept physically separated from a starter composition for the grenade to work properly. The starter composition must both be easily ignited by the propellant charge and burn at a sufficiently high temperature to penetrate the barrier separating the starter composition from the hexachloroethane.

Therefore, a need exists for a new and improved launched smoke grenade that uses hexachloroethane to produce smoke. In this regard, the various embodiments of the present invention substantially fulfill at least some of these needs. In this respect, the launched smoke grenade according to the present invention substantially departs from the conventional concepts and designs of the prior art, and in doing so provides an apparatus primarily developed for the purpose of providing a smoke grenade that is launched from a firearm and uses hexachloroethane to produce smoke.

SUMMARY OF THE INVENTION

The present invention provides an improved launched smoke grenade, and overcomes the above-mentioned disadvantages and drawbacks of the prior art. As such, the general purpose of the present invention, which will be described subsequently in greater detail, is to provide an improved launched smoke grenade that has all the advantages of the prior art mentioned above.

To attain this, the preferred embodiment of the present invention essentially comprises a cartridge case having a hollow interior that receives a primer and a propellant, a projectile received by the cartridge case, and the projectile including a smoke generation component and an ignition component. The smoke generation component and the ignition component may be separated by a barrier prior to admission of the ignition component. The ignition component may burn through the barrier to ignite the smoke generation component. The smoke generation component may include hexachloroethane. The propellant may be black powder or smokeless powder. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1A:
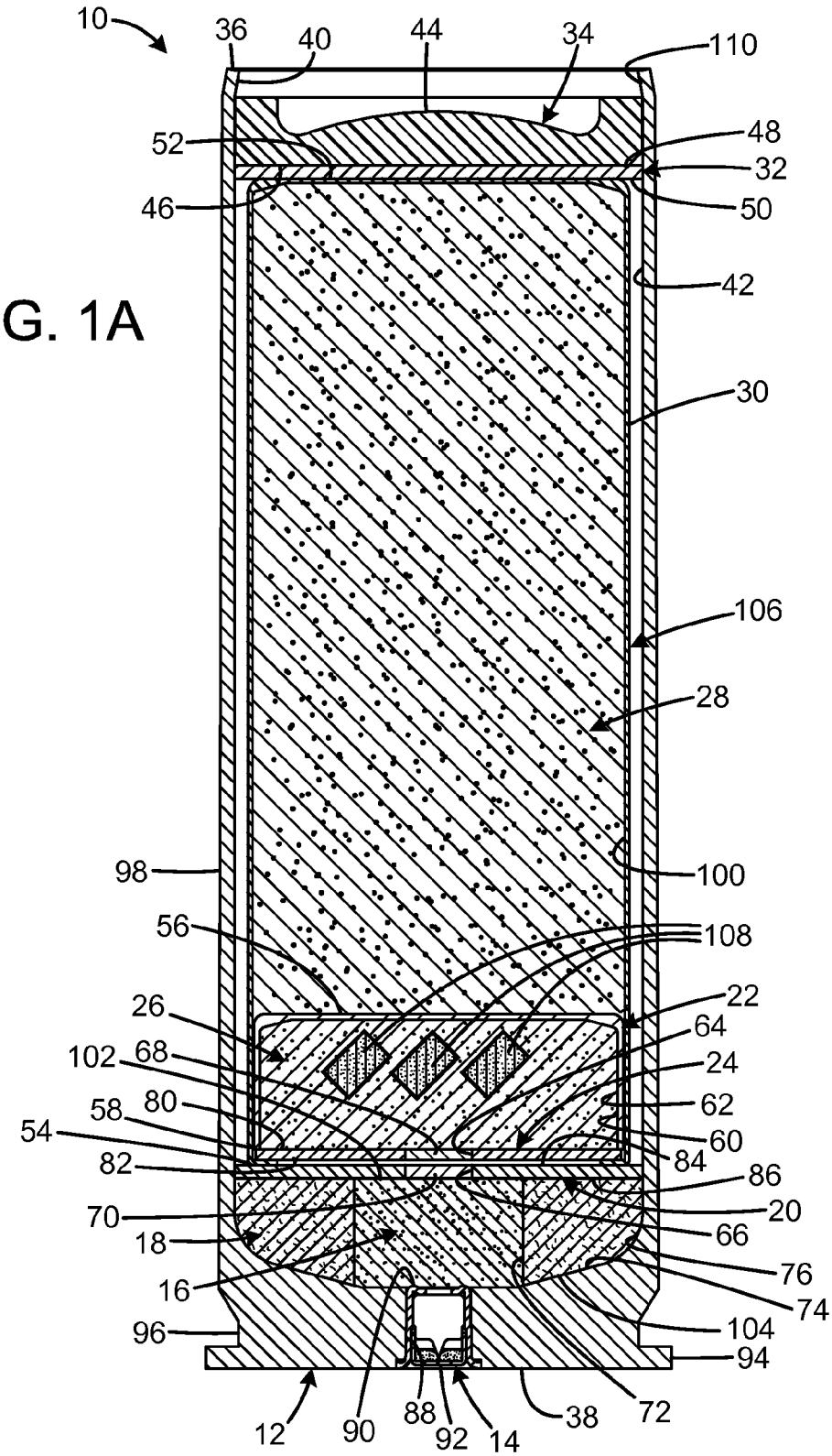
FIG. 1A is a side sectional view of the current embodiment of a black powder launched smoke grenade constructed in accordance with the principles of the present invention.

An embodiment of the launched smoke grenade of the present invention is shown and generally designated by the reference numeral 10.

Figure 1B:
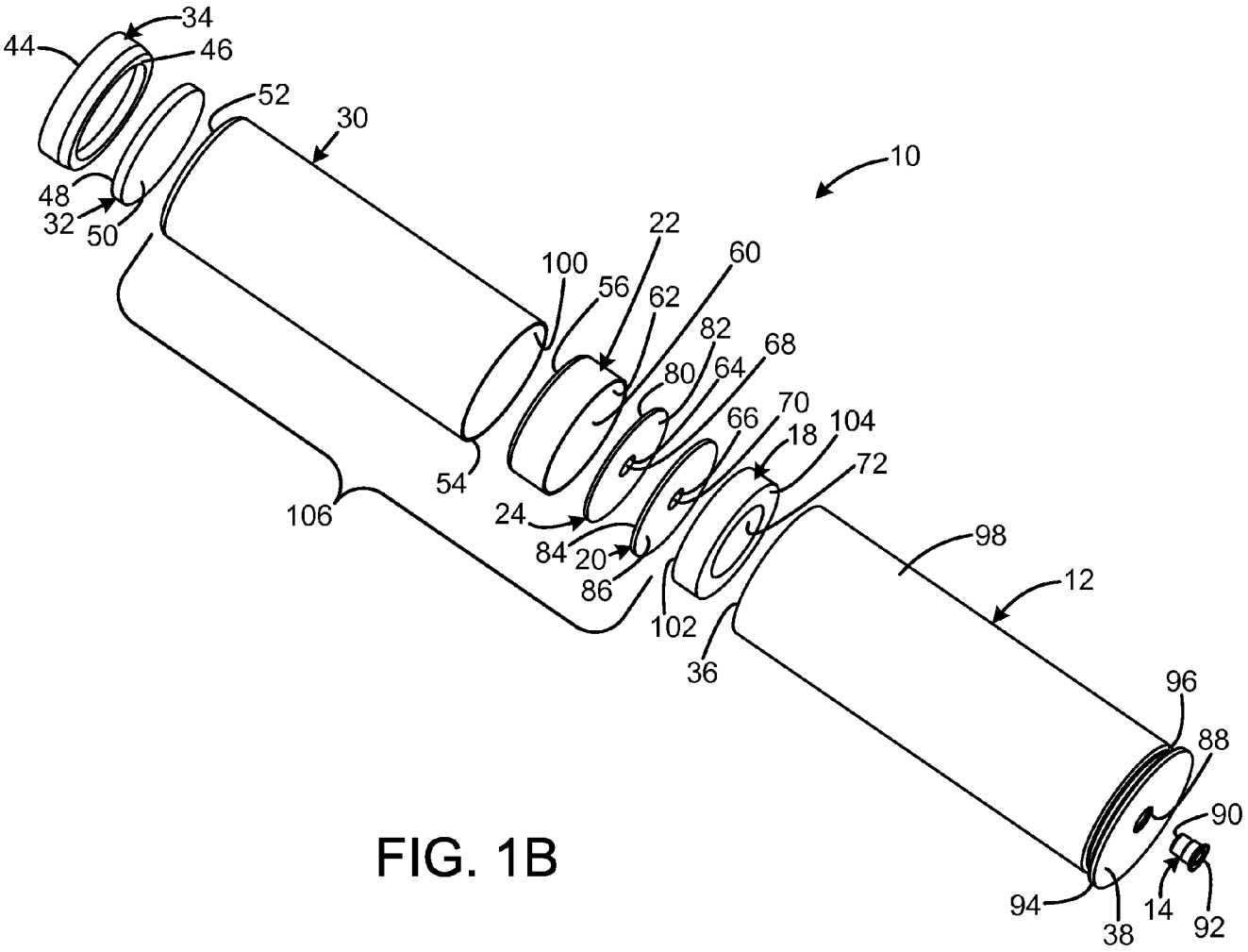
FIG. 1B is an exploded view of the current embodiment of the black powder launched smoke grenade constructed in accordance with the principles of the present invention.

FIGS. 1A and 1B illustrate the improved black powder launched smoke grenade 10 of the present invention. More particularly, the black powder launched smoke grenade has a cylindrical cartridge case 12, a primer 14, a propellant 16, a felt retaining ring 18, a projectile 106, a disc 32, and a closure wad 34. In the current embodiment, the cartridge case is a 4.8 inch cartridge for a 40 mm firearm. However, the proportions of the smoke grenade can be altered to fit a firearm of any desired size.

The cartridge case 12 has a closed bottom 38, an open top 36, and an exterior 98. A central bore 40 defines a hollow interior 42. An exterior groove 96 near the bottom defines an outwardly protruding flange 94. A primer bore 88 communicates from the exterior of the bottom to the bottom of the interior. The bottom of the interior immediately adjacent to the primer bore has an angle taper 74 that transitions to a radiused taper 76. The top 36 has an inward chamfer 110.

The primer bore is sized and shaped to closely receive the top 90 and bottom 92 of a primer 14. The primer bore receives the bottom of the primer such that the bottom of the primer is flush with the bottom 38 of the cartridge case 12. In the current embodiment, the primer is a Winchester® W209 primer for shot gun shells manufactured by Olin Corporation of Clayton, Mo.

The felt retaining ring 18 is a circular disc having a top 102, a bottom 104, and a central bore 72. The bottom is pressed flush against the bottom 38 of the interior 42 of the cartridge case 12. The bottom of the felt retaining ring conforms closely to the angle taper 74 and radiused taper 76 of the bottom of the interior. The central bore communicates with the top 90 of the primer 14. The central bore receives the propellant 16. In the current embodiment, the propellant is 1.25 g of black powder.

The projectile 106 is positioned on top of the top 102 of the felt retaining ring 18. The projectile has a washer with tab assembly 20, a starter cup 22, a washer with tab assembly 24, a starter composition 26, a hexachloroethane composition 28, and a cup 30.

The cylindrical steel cup 30 has an open bottom 54, a closed top 52, and a hollow interior 100. The starter cup 22 is sealed within the bottom of the cup 30 by the top 84 of the washer and tab assembly 20. The bottom 86 of the washer and tab assembly rests on top of the top 102 of the felt retaining ring 18. The washer portion has a central bore 66 that is filled by a tab 70. In the current embodiment, the tab is paper, and the washer and tab assembly is crimped onto the bottom of the cup 30.

The portion of the interior 100 of the cup 30 above the starter cup 22 is filled with the hexachloroethane composition 28. In the current embodiment, the hexachloroethane composition is 180±20 g of a composition consisting of 42.6% zinc oxide, 46.1% hexachloroethane, 6.5% aluminum powder, and 4.8% Pyro 5413 H Super 99.5% pure aluminum powder manufactured by ECKART GmbH of Germany (all measurements by weight).

The starter cup 22 has an open bottom 58, a closed top 56, and a hollow interior 62 defined by a central bore 60. The starter composition 26 is a solidified mass held within the starter cup by the top 80 of the washer and tab assembly 24. It is critical that the starter composition 26 be separated from the hexachloroethane composition 28 prior to use of the smoke grenade 10 because otherwise the two compositions will react and cause the smoke grenade to malfunction. The bottom 82 of the washer and tab assembly rests on top of the top 84 of the washer and tab assembly 20. The washer portion has a central bore 64 that is filled by a tab 68. In the current embodiment, the tab is paper, and the steel washer and tab assembly is crimped onto the bottom of the steel or aluminum starter cup.

The interior 62 of the starter cup 22 is filled with the starter composition 26. In the current embodiment, the starter composition is 6±3 g of a composition consisting of 22.3% nitrocellulose, 11.1% of M8 Starter consisting of 34.8% potassium nitrate, 25.7% silicon, 4.1% charcoal, 21.7% black iron oxide, and 13.7% aluminum powder, and 66.6% of Ignition Pellets 108 consisting of 15.9% aluminum powder, 49.9% black iron oxide, 29% barium nitrate, 3.2% sulfur, and 2% vinyl alcohol-acetate resin (VAAR) as a binder. The starter composition burns at about 4000 to 5000° F., which is sufficient to melt the closed top 56 of the starter cup (which melts at about 1000° F.) and subsequently ignite the hexachloroethane composition. The ignition pellets have a height of about 0.345-0.350 inches and a weight of about 2.5 g, and the M8 Starter is a thick slurry that hardens into a solid mass.

The bottom 50 of the disc 32 is positioned in contact with the top 52 of the cup 30 to removably seal the projectile 106 within the cartridge case 12. In the current embodiment, the disc is made of steel, aluminum, or cardboard. The disc is secured within the cartridge case by a silicon sealant.

The bottom 46 of the closure wad 34 is positioned in contact with the top 48 of the disc 32 to removably retain the projectile 106 and disc within the cartridge case 12. The closure wad 34 is made of Poly(styrene-butadiene-styrene), or SBS, which is a hard elastomer. The top 44 of the closure wad is convex that terminates in an upward protrusion around the rim. The chamfer 110 at the top 36 of the cartridge case serves to removably retain the closure wad.

Upon impact by the firing pin of a firearm, the primer 14 generates a flash that ignites the propellant 16. The flame generated by the ignited propellant burns through the tabs 70, 68, which are invisible to the propellant flame path, and is directed by the bores 66, 64 in the washer and tab assemblies 20, 24 into the starter composition 26. The gases generated by the ignited propellant serve to push the projectile 106 upward with sufficient force to push the disc 32, closure wad 34, and projectile out through the open top 36 of the cartridge case 12. The disc and closure wad merely provide environmental closure and retain the projectile in the cartridge case. Both the disc and the closure wad pop off with some small resistance in response to discharge. While the projectile is in flight, the starter composition melts the starter cup 22 and subsequently ignites the HC composition 28. The HC composition 28 emits thick black smoke as it burns via the opening in the bottom 58 of the starter cup and the bottom 54 of the cup 30.

Figure 2A:
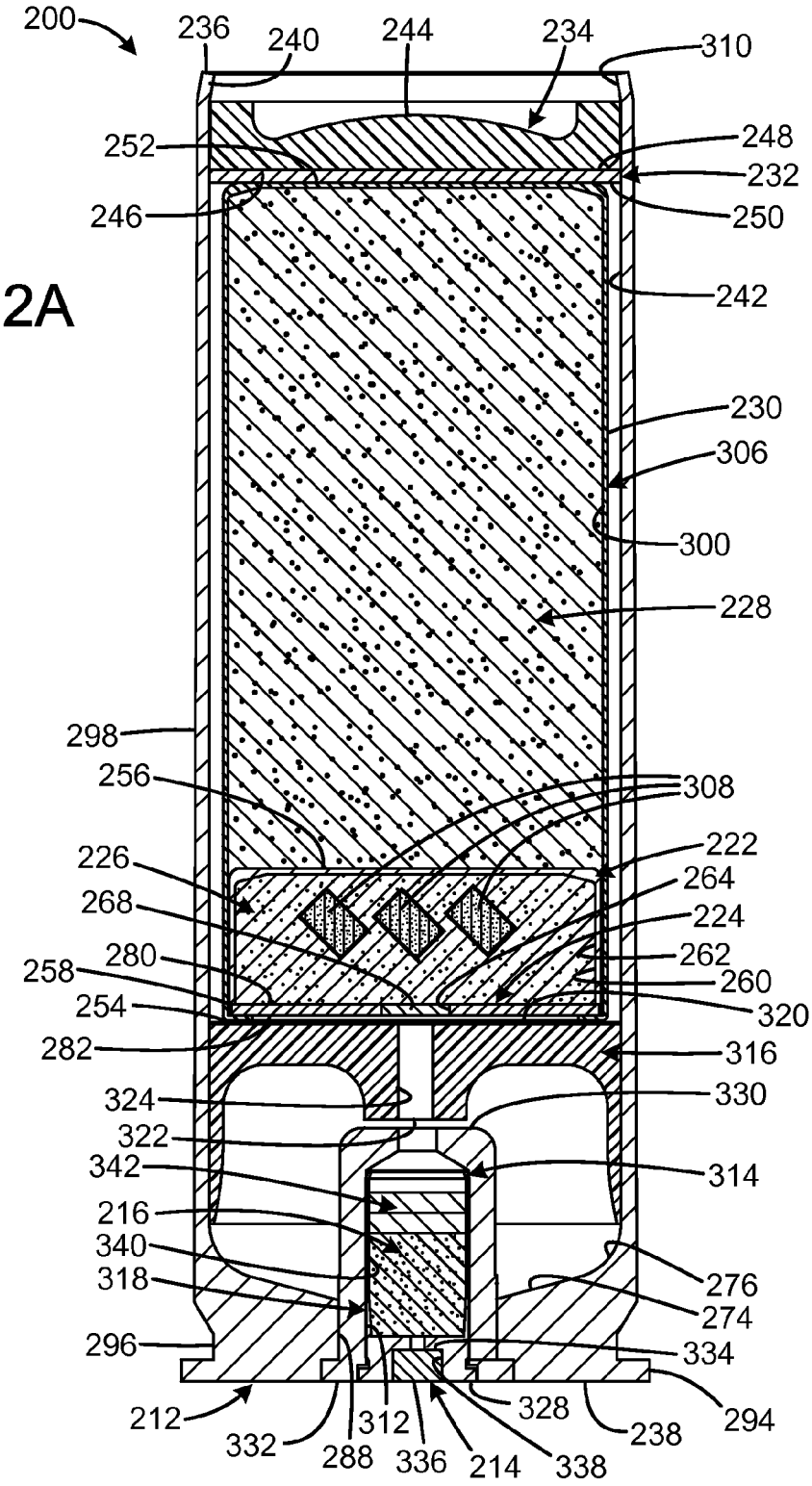
FIG. 2A is a side sectional view of the current embodiment of a smokeless powder launched smoke grenade constructed in accordance with the principles of the present invention.
Figure 2B:
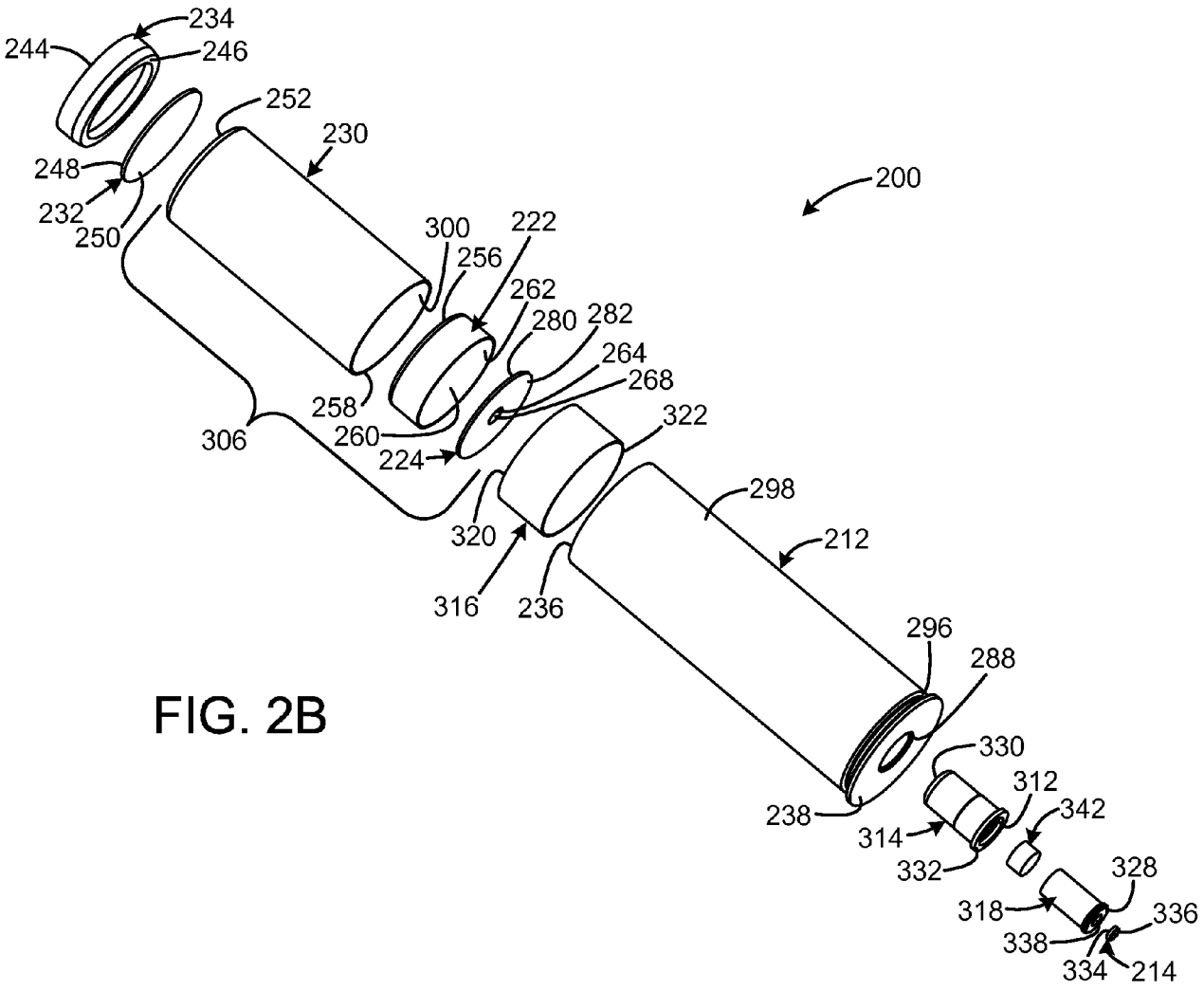
FIG. 2B is an exploded view of the current embodiment of the smokeless powder launched smoke grenade constructed in accordance with the principles of the present invention.

FIGS. 2A and 2B illustrate the improved smokeless powder launched smoke grenade 200 of the present invention. More particularly, the smokeless powder launched smoke grenade has a cylindrical cartridge case 212, a .038 cartridge assembly 318, a pressure chamber 314, a pressure wad 316, a projectile 306, a disc 232, and a closure wad 234. In the current embodiment, the cartridge case is a 4.8 inch cartridge for a 40 mm firearm. However, the proportions of the smoke grenade can be altered to fit a firearm of any desired size.

The cartridge case 212 has a closed bottom 238, an open top 236, and an exterior 298. A central bore 240 defines a hollow interior 242. An exterior groove 296 near the bottom defines an outwardly protruding flange 294. A pressure chamber bore 288 communicates from the exterior of the bottom to the bottom of the interior. The bottom of the interior immediately adjacent to the pressure chamber bore has an angle taper 274 that is tapered upward that transitions to a radiused taper 276. The top 236 has an inward chamfer 310

The pressure chamber bore 288 is sized and shaped to closely receive the top 330 and bottom 332 of the pressure chamber 314. The pressure chamber bore receives the bottom of the pressure chamber such that the bottom of the pressure chamber is flush with the bottom 238 of the cartridge case 212. The steel pressure chamber defines a central cartridge bore 312 that is sized and shaped to receive the .038 cartridge assembly 318. The uppermost portion of the central cartridge bore tapers to a narrow passage that communicates with the top 330 of the pressure chamber.

The bottom 328 of the cartridge assembly 318 defines a primer bore 338. The primer bore is sized and shaped to closely receive the top 334 and bottom 336 of a primer 214. The primer bore receives the bottom of the primer such that the bottom of the primer is flush with the bottom 238 of the cartridge case 212. In the current embodiment, the primer is a Winchester® WSP primer for small regular pistols manufactured by Olin Corporation of Clayton, Mo.

The primer bore 332 terminates in a narrow passage that communicates with the interior 340 of the cartridge assembly 318. The interior of the cartridge assembly above the primer bore is filled with the propellant 216 and capped by a filler plug 342. The propellant is 1.25 g of smokeless propellant in the current embodiment. The filler plug is made of polystyrene foam in the current embodiment and retains the smokeless propellant in the cartridge assembly. The cartridge assembly is coated with a moisture proof varnish after the smoke grenade 200 is fully assembled.

The pressure wad 316 is positioned immediately above the pressure chamber 314. The bottom 322 of the pressure wad approximates an inverted W piston shape that defines two expansion chambers on either side of the pressure chamber and provides the pressure wad with structural integrity. The expansion chambers enable the substantial pressure spike caused by the smokeless powder propellant 216, which is much greater than the pressure spike resulting from the slower burning black powder used in the black powder launched smoke grenade 10, to be buffered and emitted in a controlled manner when the pressure wad is pushed out of the cartridge case 212. The pressure wad also defines a central bore 324 that communicates with the top 320 of the pressure wad.

The projectile 306 is positioned on top of the top 320 of the pressure wad 316. The projectile has a starter cup 222, a washer and tab assembly 224, a starter composition 226, a hexachloroethane composition 228, and a cup 230.

The cylindrical steel cup 230 has an open bottom 254, a closed top 252, and a hollow interior 300. The starter cup 222 is sealed within the bottom of the cup 230 by the top 280 of the washer and tab assembly 224. The bottom 282 of the washer rests on top of the top 320 of the pressure wad 316. The washer portion has a central bore 264 that is filled by a tab 268. In the current embodiment, the tab is paper, and the steel washer and tab assembly is crimped onto the bottom of the cup 230 and the bottom of the steel or aluminum starter cup.

The portion of the interior 300 of the cup 230 above the starter cup 222 is filled with the hexachloroethane composition 228. In the current embodiment, the hexachloroethane composition is 127±20 g of a composition consisting of 42.6% zinc oxide, 46.1% hexachloroethane, 6.5% aluminum powder, and 4.8% Pyro 5413 H Super 99.5% pure aluminum powder manufactured by ECKART GmbH of Germany (all measurements by weight).

The starter cup 222 has an open bottom 258, a closed top 256, and a hollow interior 262 defined by a central bore 260. The starter composition 226 is a solidified mass held within the starter cup by the top 280 of the washer and tab assembly 224. It is critical that the starter composition 226 be separated from the hexachloroethane composition 228 prior to use of the smoke grenade 200 because otherwise the two compositions will react and cause the smoke grenade to malfunction.

The interior 262 of the starter cup 222 is filled with the starter composition 226. In the current embodiment, the starter composition is 6±3 g of a composition consisting of 22.3% nitrocellulose, 11.1% of M8 Starter consisting of 34.8% potassium nitrate, 25.7% silicon, 4.1% charcoal, 21.7% black iron oxide, and 13.7% aluminum powder, and 66.6% of Ignition Pellets 308 consisting of 15.9% aluminum powder, 49.9% black iron oxide, 29% barium nitrate, 3.2% sulfur, and 2% vinyl alcohol-acetate resin (VAAR) as a binder. The starter composition burns at about 4000 to 5000° F., which is sufficient to melt the closed top 256 of the starter cup (which melts at about 1000° F.) and ignite the hexachloroethane composition. The ignition pellets have a height of about 0.345-0.350 inches and a weight of about 2.5 g, and the M8 Starter is a thick slurry that hardens into a solid mass.

The bottom 250 of the disc 232 is positioned in contact with the top 252 of the cup 230 to removably seal the projectile 306 within the cartridge case 212. In the current embodiment, the disc 232 is made of steel, aluminum, or cardboard. The disc is secured within the cartridge case by silicon sealant.

The bottom 246 of the closure wad 234 is positioned in contact with the top 248 of the disc 232 to removably retain the projectile 306 and disc within the cartridge case 212. The closure wad 234 Poly(styrene-butadiene-styrene), or SBS, which is a hard elastomer. The top 244 of the closure wad is convex that terminates in an upward protrusion around the rim. The chamfer 310 at the top 236 of the cartridge case serves to removably retain the closure wad.

Upon impact by the firing pin of a firearm, the primer 214 generates a flash that ignites the propellant 216. The flame generated by the ignited propellant burns through the filler plug 342 and is directed by the tapered uppermost portion of the pressure chamber 314 into the bore 324 in the pressure wad 316. The flame subsequently burns through the tab 268, which is invisible to the propellant flame path, and is directed by the bore 264 in the washer and tab assembly 224 into the starter composition 226. The gases generated by the ignited propellant serve to push the projectile 306 upward by exerting sufficient force on the pressure wad 316 to push the disc 232, closure wad 234, projectile, and pressure wad out through the open top 236 of the cartridge case 212. The disc and closure wad merely provide environmental closure and retain the projectile in the cartridge case. Both the disc and the closure wad pop off with some small resistance in response to discharge. While the projectile is in flight, the starter composition melts the starter cup 222 and subsequently ignites the HC composition 228. The HC composition 228 emits thick black smoke as it burns via the opening in the bottom 258 of the starter cup and the bottom 254 of the cup 230.

The black powder launched smoke grenade 10 has the benefit of delivering a larger quantity of smoke then the smokeless powder launched smoke grenade 200. However, the use of black powder as the propellant creates fouling in the firearm used to launch the black powder launched smoke grenade. The smokeless powder launched smoke grenade does not foul the firearm used to launch the smokeless powder launched smoke grenade, but has a decreased quantity of hexachloroethane.

While current embodiments of launched smoke grenades have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A smoke grenade comprising:

a cartridge case having a hollow interior that receives a primer and a propellant;

a projectile received by the cartridge case;

the projectile including a smoke generation component and an ignition component;

wherein the ignition component is proximate the propellant such that combustion of the propellant ignites the ignition component:

wherein the smoke generation component and the ignition component are separated by a barrier prior to ignition of the ignition component; and wherein the smoke generation component comprises hexachloroethane.

2. The grenade of claim 1 wherein the ignition component burns through the bather to ignite the smoke generation component.

3. The grenade of claim 2 wherein the smoke generation component includes at least 45% by weight hexachloroethane.

4. The grenade of claim 1 wherein the propellant is black powder.

5. The grenade of claim 1 wherein the primer is a shotgun shell primer.

6. The grenade of claim 1 further comprising an environmental closure element attached to the cartridge case that retains the projectile within the cartridge case prior to ignition of the propellant.

7. The grenade of claim 1 further comprising a piston that defines an expansion chamber that receives gases generated by the ignited propellant and emits the gases from the cartridge case in a controlled manner.

8. The grenade of claim 1 wherein the cartridge case is a 4.8 inch cartridge for a 40 mm firearm.

9. The grenade of claim 1 wherein the barrier is selected from the group consisting of steel and aluminum.

10. The grenade of claim 9 wherein the ignition component burns at a sufficiently high temperature to melt the barrier.

11. The grenade of claim 1 wherein the smoke generation component is proximate the ignition component such that combustion of the ignition component ignites the smoke generation component while the grenade is in flight prior to approaching a target.

12. The grenade of claim 1 further comprising the cartridge case defining a passage communicating between the smoke generation component and the external environment that receives gases generated by the smoke generation component and emits the gases generated by the smoke generation component from the cartridge case in a controlled manner.

* * * * *